US005269244A

United States Patent [19]

Cataletto

[11] Patent Number: 5,269,244

[45] Date of Patent: Dec. 14, 1993

[54] THREAD PROCESSING MACHINE HAVING A THREAD CHANGING DEVICE

[75] Inventor: Alessandro Cataletto, Biassono, Italy

[73] Assignee: Alkotex S.R.L., Milan, Italy

[21] Appl. No.: 893,538

[22] Filed: Jun. 2, 1992

[30] Foreign Application Priority Data

Jun. 3, 1991 [DE] Fed. Rep. of Germany ..... 4118130

[51] Int. Cl.[5] ..... D05B 81/00; B65H 57/12

[52] U.S. Cl. ..... 112/302; 112/DIG. 2; 57/261

[58] Field of Search ..... 112/302, 163, 241, 98, 112/DIG. 2, DIG. 3; 57/261, 22

[56] References Cited

U.S. PATENT DOCUMENTS 3,067,704 12/1962 Pedersen ..... 112/302 X 4,217,749 8/1980 Rohner et al. ..... 57/22 X 4,531,467 7/1985 Golia, Jr. et al. ..... 112/163 X 4,561,368 12/1985 Willenbacher ..... 112/302 X

OTHER PUBLICATIONS

High-Speed Automatic Embroidering Machine, Jimbo 2000-3000 Series (brochure).

*Primary Examiner*—Peter Nerbun

*Attorney, Agent, or Firm*—Laff, Whitesel, Conte & Saret

[57] ABSTRACT

A thread processing machine, in particular an embroidering machine, is provided with a thread joining device, which has a whirl chamber and a compressed air nozzle, in which two threads of different color, one used after the other, are joined together by compressed air vortex connection of their filaments, after which they are drawn through the needle.

10 Claims, 4 Drawing Sheets

THREAD PROCESSING MACHINE HAVING A THREAD CHANGING DEVICE

FIELD OF THE INVENTION

The invention relates to a thread processing machine, in particular an embroidering machine with a thread changing device, with a reel carrier, a thread tightener for a thread drawn off a reel in a direction of thread drawing, a thread lever and a reciprocatingly drivable needle.

BACKGROUND OF THE INVENTION

Thread changing devices of embroidering machines serve to carry out changes of color, i.e. to make possible the use of threads of different colors and as the case may be of different kinds one after the other. To this effect known embroidering machines, and in particular small embroidering machines, have as many needle bars as colors to be used, i.e. an independent needle bar with a needle, a thread lever and a thread tightener are available for each different thread and come into operation one after the other. Such solutions are extraordinarily expensive with a view to construction. Moreover, there is a limited number of threads of different colors. In practice the limit of the number of needle bars and thus of the number of colors to be used is between 9 to 10. If more colors and consequently,,more needle bars are to be used, the mechanical expenditure, in particular the constructional expenditure, increases, the embroidering head becoming wider. This will in turn strongly restrict the repeat distance from one embroidering head to the neighbouring embroiding head (see leafet of JEMCO CO., LTD., No. 8-6 Kikukawa 1 chome, Sumida-ku, Tokyo, 130, Japan, "HIGH-SPEED AUTOMATIC EMBROIDERING MACHINE").

Further, it has also become known to provide each thread with a thread lever of its own including a thread tightener and a needle of its own, while only one needle bar is available altogether. The latter is displaced laterally for any change of color. The needle then to be used is coupled with the needle bar. The basic problem of limited colors is not solved either (see leaflet Maschinenfabrik Carl Zangs Aktiengesellschaft, D-4150 Krefeld/Federal Republic of Germany, publication no. 172-6 E "Zangs-Multi-Stickronic 172-12 E 172-8 E 172-6 E").

However, it has meanwhile become desirable to use a by far greater number of colors than mentioned before.

SUMMARY OF THE INVENTION

It is an object of the invention to create a machine of the generic kind which strongly reduces the mechanical expenditure necessary for the change of thread conditioned by the change of color and which is without any practical limitation of the number of threads to be used.

In accordance with the invention this object is attained in that, in the direction of thread drawing, the reel carrier is followed by a thread joining device having a channel-type whirl chamber, into which opens a compressed air nozzle. It is the essence of the invention that the thread actually in use is joined to the beginning of the next thread of different color by air vortex connection, and that the following thread is drawn through the needle with the aid of the advancing thread, which is possible there being no knots or the like. This air vortex produced section, where the threads have been joined together, can be drawn through the thread tightener, the eye of the thread lever and in particular the eye of the needle. The advancing thread to be replaced by a following thread of different color is clipped right after the connection has been produced. Theoretically, this can be done by hand, but functionally, this is done by the advantageous further development according to which the thread joining device is associated with a thread cutting device. Further, the section of air-vortex connection of the advancing thread with the following thread is cut out. This happens after this section has been drawn through the needle eye. When a thread drawing device is arranged downstream of the needle in the direction of thread drawing, this reflects a functional development of drawing out the thread or this section, respectively. The clipping may then take place manually or by means of an advantageous development according to which a thread clipper is arranged downstream of the needle in the direction of thread drawing. The correct association of a new thread to be fed may be realized by the embodiment according to which, between the reel carrier and the thread joining device, a thread feeder is provided to feed a thread to the thread joining device.

The joining of the two threads in the thread joining device takes place in a known manner in an apparatus placed on the marked as ClipJet by Heberlein Maschinenfabrik AG of CH-9630 Wattwil, Switzerland (see leaflet "ClipJet-FT" of Heberlein Maschinenfabrik AG). Such known apparatuses are used in texturizing and also in spinning technique. They proceed from the filaments of a thread being unravelled and whirled in the whirl chamber by compressed air. Surprisingly, it has been found that two threads commonly introduced will be joined together by their filaments being whirled. Further, it has surprisingly been found that this connection is sufficiently stable for the two different threads joined together to be drawn through the thread tightener, the thread lever and the needle.

Further advantages, features and details of the invention will result from the ensuing description of examples of embodiments taken in conjunction with the drawing.

DESCRIPTION OF THE PREFERRED EMBODIMENTS

Figure 1:
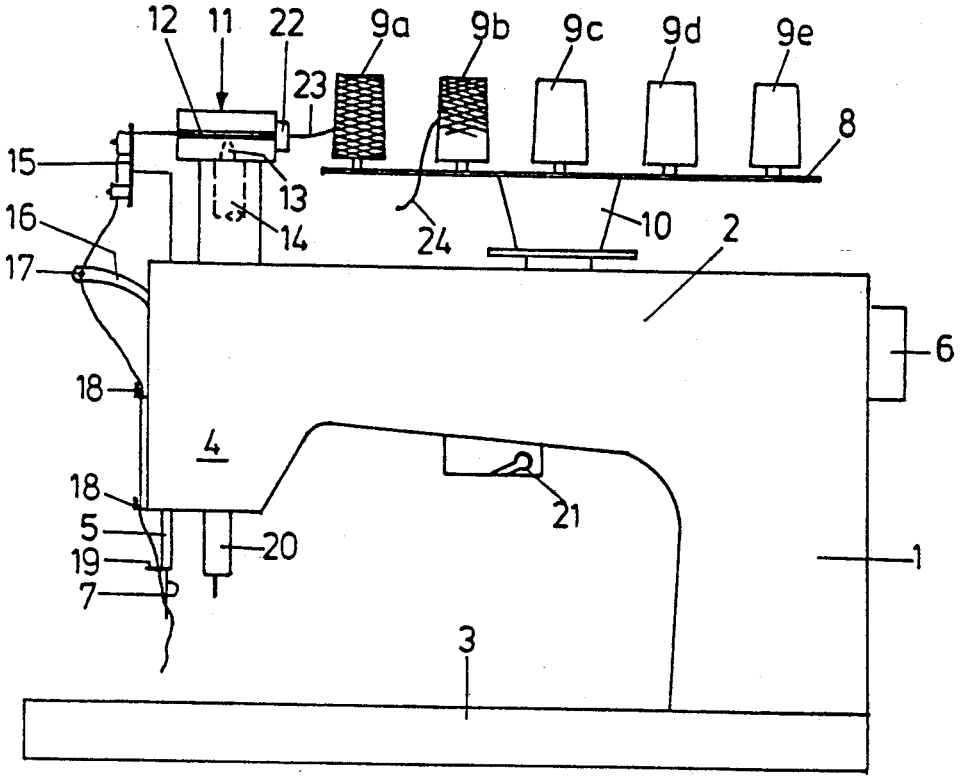
FIG. 1 is a lateral view of a small embroidering machine in a strongly diagrammatic representation.

The embroidering machine shown in the drawing conventionally has a standard 1, an upper arm 2 and a lower arm conventionally designated as the base plate 3.

In the vicinity of its free end the upper arm 2 has an embroidering head 4, in which a needle bar 5 is placed for reciprocating movement in the vertical direction. The drive is effected by a drive motor 6 outlined only diagrammatically. The needle bar 5 has a needle 7. A reel carrier 8 is arranged on the upper arm 2 and has any number of reels 9*a*, 9*b*, 9*c*, 9*d*, 9*e* arranged on it. The reel carrier 8 is in turn provided with a feeder 10, in the present case a rotary feeder, which may however also be a linear feeder to place individual reels 9*a* to 9*e* into a position of operation still to be explained.

A thread joining device 11 is arranged on the embroidering head 4. It has a channel-type whirl chamber 12, into the middle of which a compressed air nozzle 13 opens in a direction perpendicular to the direction of the whirl chamber and is actuated by compressed air via a compressed air connection from a compressed air source not shown.

The thread joining device 11 is followed by a conventional thread tightener 15 equally arranged on the embroidering head 4 and in turn followed by a conventional reciprocating thread lever 16 with an eye 17. Placed between the thread lever 16 and the needle 7 there are still thread guiding eyes 18 arranged on the embroidering head 4 and a thread guiding eye 19 arranged on the needle bar 5.

Further, a thread clipper 20 is provided to the bottom side of the embroidering head and is followed by a thread drawing device 21, which may be arranged on the bottom side of the arm 2.

A thread cutting device is provided on the side of the thread joining device 11 facing the reel carrier 8.

During normal embroidering operation of the embroidering head 4 according to the illustration in FIG. 1, a thread 23 is piloted from a reel 9*a* through the channel-type whirl chamber 12 of the thread joining device and continues through the thread tightener 15, the eye 17 of the thread lever 16, the thread guiding eyes 18, 19 and the eye of the needle 7 not to be seen in the drawing. Normal embroidering takes place. No compressed air is supplied to the whirl chamber 12.

Figure 2:
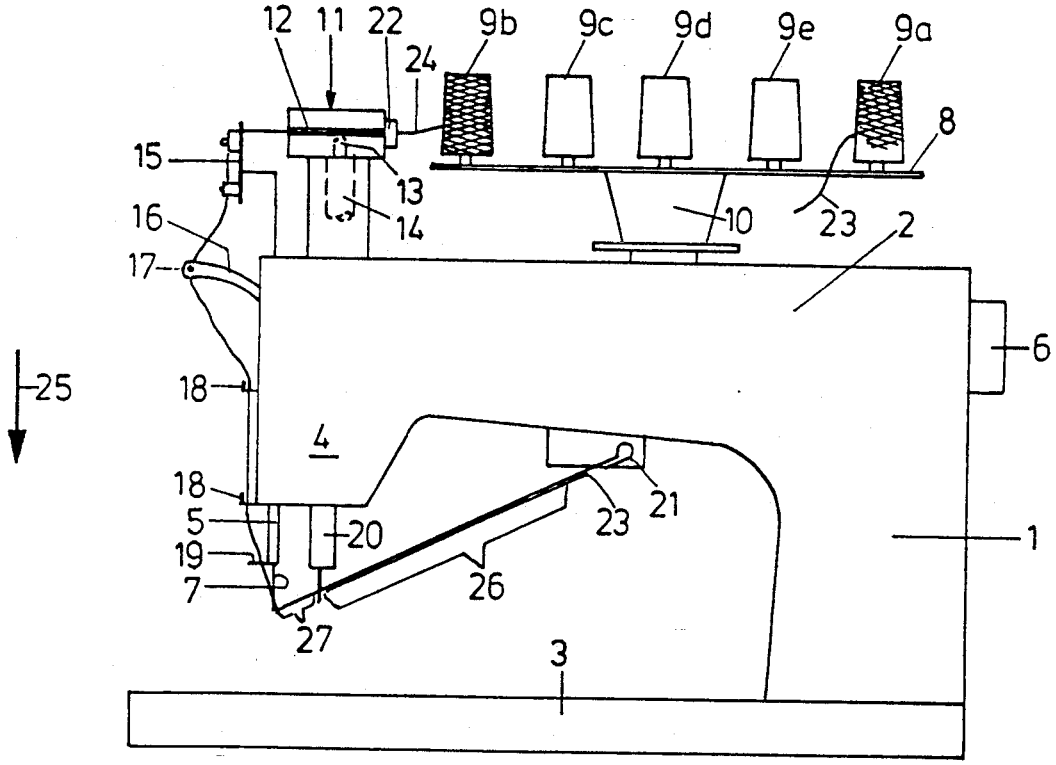
FIG. 2 shows the small embroidering machine during a change of thread.

When a change of color is needed, i.e. when another thread 24, for instance from the reel 9*b* is to be worked with, then the machine is stopped and the thread 23 is cut off by means of a clipper not shown located in the base plate 3, and the free end of this thread 23 is seized by the thread drawing device 21. By means of the feeder 10 the reel carrier 8 is adjusted such that the reel 9*b* is placed in front of the thread joining device 11, as shown in FIG. 2. The new, subsequent thread 24 is pneumatically or mechanically introduced into the whirl chamber 12 by hand or by way of a known thread feeder. The thread drawing device 21 draws the thread 23 through the whirl chamber 12. Now compressed air is supplied to the compressed air nozzle via the compressed air connection 14, whereby the above-specified whirling of the filaments of the two threads 23, 24 is effected, and whereby they are joined together along a section 26, of which the length depends on the throughput speed of the threads 23, 24 and on the time of actuation by compressed air.

Before this section 26 reaches the thread tightener 15 arranged down-stream in the thread drawing direction 15, the advancing "old" thread 23 is cut off by the thread cutting device 22, so that now only the following thread 24 is drawn off the corresponding reel 9*b*. The advancing "old" thread 23 is drawn out so far by the thread drawing device 21 that the section 26 along which the threads 23, 24 are joined together is drawn through the needle, namely to such an extent that in the thread drawing direction 25 a section 27 of about 30 to 35 mm remains which is only formed by the following thread 24. The length of this section 27 is necessary to assure a reliable new start of embroidering. At the end of this section 27 the section 26 is cut off by means of the thread clipper 20. Subsequently, embroidering can take place with the following thread 24 of different color. Of course, the thread tightener 15 is released when the threads 23, 24 are drawn out by the thread drawing device 21.

Triggering of all devices and units may be fully automatic, in particular program-controlled by the central control unit, by way of which also the embroidering patterns, i.e. the movements of the embroidering machine, are controlled.

Fundamentally, there is also the possibility to use the change of threads for another color according to the invention also with sewing machines, for instance in crocheting or linking machines, chain-stitch sewing machines or also lockstitch machines.

Figure 3:
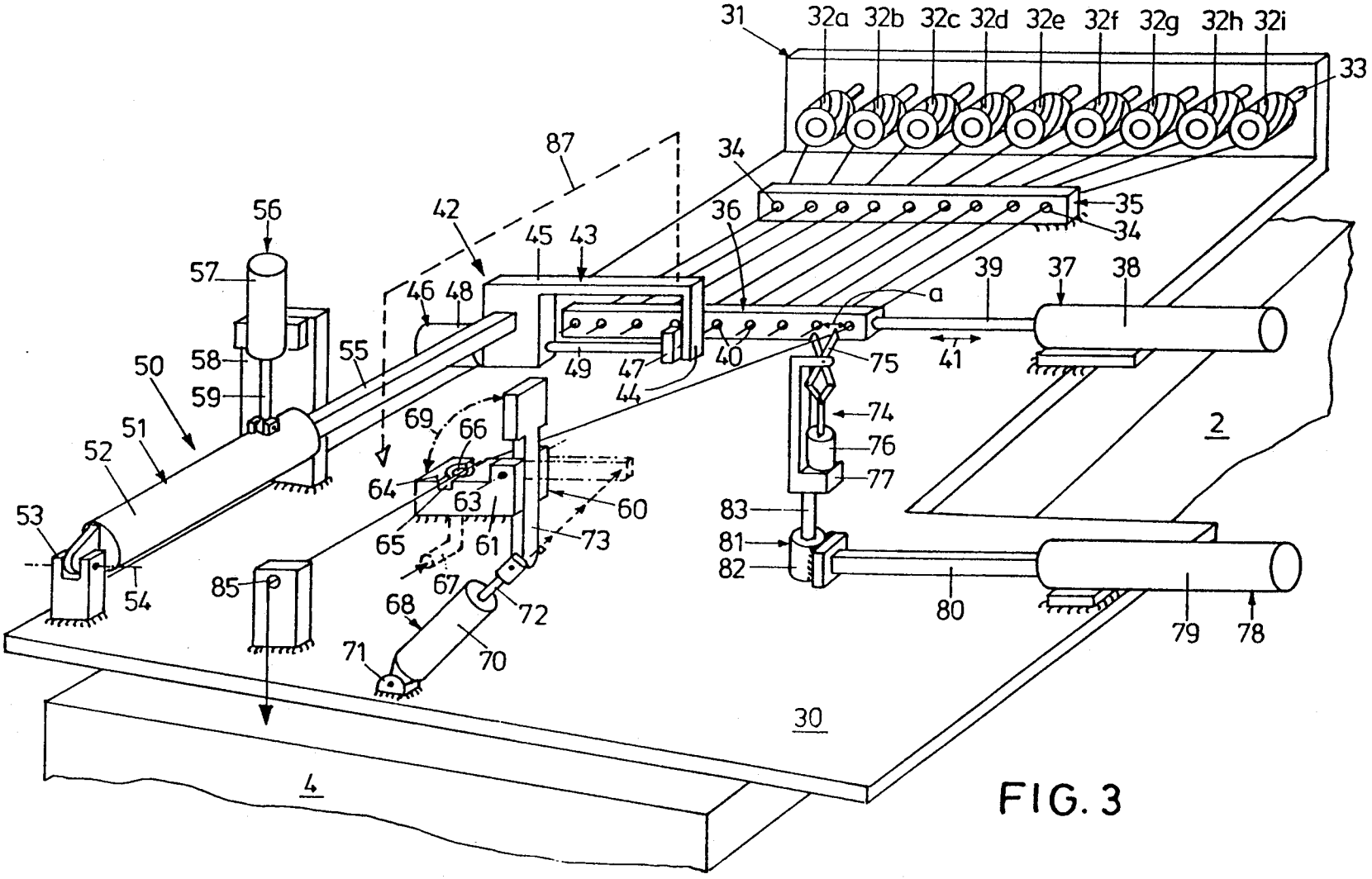
FIG. 3 is a perspective, diagrammatic representation of an arrangement to be attached to a small embroidering machine comprising a reel carrier, a thread gripper and feeder, a thread cutting device and a thread joining device.

In the example of embodiment according to FIG. 3 a base plate 30 is arranged on the upper arm 2 with the embroidering head 4 of the embroidering machine and has a stationary reel carrier 31 on it, on which reels 32*a* to 32*i* are pivotably supported on journals 33. Parallel to the plane of the base plate 30 and of the plane of the reels 32*a* to 32*i* guiding eyes are provided formed in a common guiding body 35. The latter is arranged to be stationary on the base plate 30. An eyed rack 36 is provided in parallel to this rod-like guiding body 35 and is displaceable in its longitudinal direction by means of a rack drive 37. The rack drive 37 is a linear drive, i.e. a piston-cylinder drive to be actuated by a pressure medium. Its cylinder 38 is secured to the base plate 30, whereas its piston rod 39 is secured to the eyed rack 36, equally has the form of a rod. The rack drive 37 is structured in known manner such that it can adjust the eyed rack 36 stepwise, i.e. at a pitch corresponding to the distance a of two neighbouring eyes 40 formed in the eyed rack 36 in each case at the same distance from each other in the direction of displacement 41 of the latter.

On the side of the eyed rack 36 facing away from the guiding body 35 with the guiding eyes 34 a thread gripper and feeder 42 is provided on the base plate 30. It has a gripper 43 working in the way of grip pliers. It has a gripper abutment 44 which is formed by one leg of a gripper body 45 in the form of a C open to the bottom. Further, a gripper stamp 47 displaceable by means of a gripper drive 46 is provided on the gripper body 45 and cooperates with the gripper abutment 44. The gripper drive 46 is a linear drive, namely a piston-cylinder drive to be actuated by a pressure medium. Its cylinder 48 is secured to the gripper body 45, while the gripper stamp 47 is arranged on the free end of its piston rod 49, so that the gripper stamp 47 can be displaced in the direction of the eyes 40 arranged one beside the other, namely from a position in which it rests against the gripper abutment 44 into a position spaced away, in which the piston rod 49 has at least partially entered the cylinder 48.

The gripper body 45 extending in parallel to the eyed rack 36 is displaceable by means of a thread feeder 50 equally part of the thread gripper and feeder 42. This thread feeder has a feeder drive 51 in the form of a linear drive, i.e. again a pressure-means-actuatable piston-cylinder drive. Its cylinder 52 is secured to the base plate 30 by means of a pivot bearing 53, of which the pivot axis 54 extends in parallel to the direction of displacement 41 of the eyed rack 36. A piston rod 55, on the free end of which the gripper body 45 is arranged, is guided out of the end of the cylinder 52 opposite to the pivot bearing 53.

A lifting drive 56 engages with the feeder drive 51 and is in the form of a linear drive, namely a pressure-medium-actuatable piston-cylinder drive. Its cylinder 57 is connected with the base plate 30 by way of a support 58. Its piston rod 59 is articulated on the cylinder 52 of the feeder drive 51 and is able to pivot the latter about the pivot axis 54 of the pivot bearing 53. In this way the gripper body 45 can be brought into a position more spaced away from the base plate 30.

A thread joining device 60 is arranged on the base plate 30 equally on the side of the eyed rack 36 facing away from the guiding body 35 and is basically identical with the thread joining device 11 according to FIGS. 1 and 2. It has a basic body 61 stationarily arranged on the base plate 30 and on which an upper cover 62 is supported to be pivotable about a pivot axis 63. On the top side 64 of the basic body 61 is formed a channel-type whirl chamber 65 closed when the cover 62 is put on and open upwards when the cover 62 is pivoted away. A compressed-air nozzle 66 opens into this whirl chamber 65 centrally and perpendicularly to its longitudinal direction and is actuated with compressed air via a compressed air connection 67 from a compressed air source not shown. By means of a pivoting drive 68 the cover 62 can be pivoted from the position shown in solid lines in FIG. 3 in the pivoting direction 69 into a position in which it closes the whirl chamber 65. The pivoting drive 68 is also in the form of a pressure-medium-actuatable piston-cylinder drive, of which the cylinder 70 is arranged on the base plate 30 by means of a pivot bearing 71, while the piston rod 72 is articulated on a pivot lever 73 connected with the cover 62.

Further, a thread cutting device 74 is provided having a thread cutter 75 structured as a kind of scissors. Inclusive of a cutter drive 76 this thread cutter 75 is arranged on a support 77 displaceable in parallel to the direction of displacement 41 and on a vertical line. For conveyance in parallel to the direction of displacement 41 a displacement drive 78 is provided, which is in the form of a pressure-medium-actuatable piston-cylinder drive in the same way as the cutter drive. Its cylinder 79 is secured to the base plate 30, an elevating drive 81 being arranged on the free end of its piston rod 80. This elevating drive 81 is also in the form of a linear drive, namely a pressure-medium-actuated piston-cylinder drive, of which the cylinder 82 is arranged on the piston rod 80, while its piston rod 83 carries the support 77 with the thread cutter 75. The displacement drive 78 same as the rack drive 37 is formed in known manner such that its piston rod can be extracted or extracted or entered always in identical steps, the pitch corresponding to the distance of a neighbouring eyes 40 in the eyed rack 36. In this way the thread cutter 75 can be placed in front of each eye 40 in the eyed rack 36. The thread cutting device 74 is arranged right ahead of the eyed rack 36.

Figure 4A:
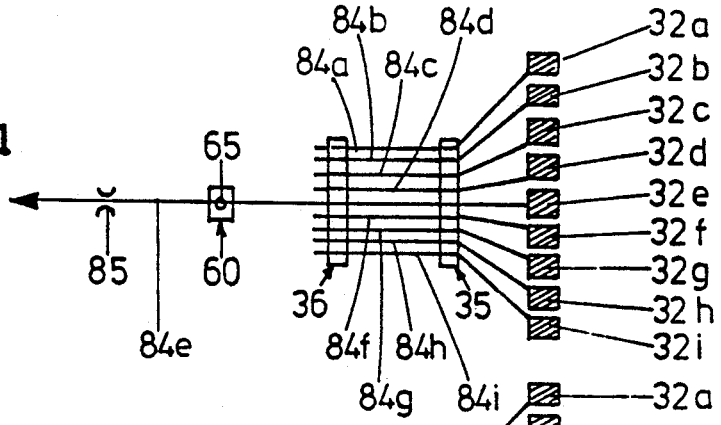
FIGS. 4*a* to 4*e* shows the operating sequence of the embodiment according to FIG. 3 when a new thread is fed.
Figure 4B:
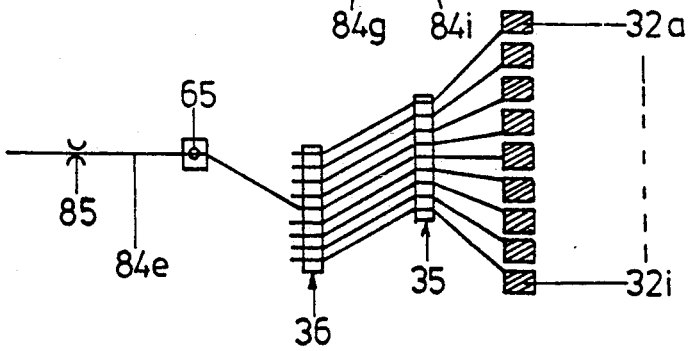
Figure 4C:
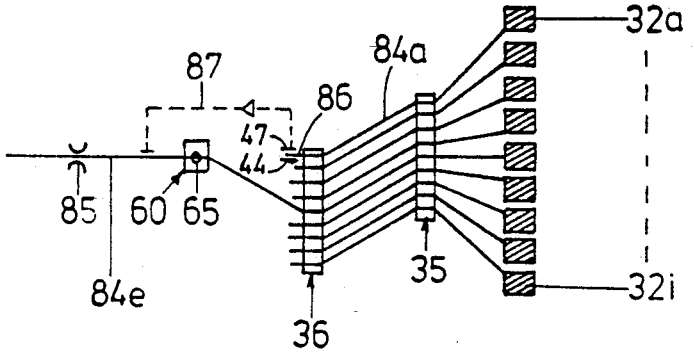

In the following the function is explained with simultaneous reference to FIGS. 4*a* to 4*e*. A thread 84*a* to 84*i* is drawn off each reel 32*a* to 32*i*, it is led through a guiding eye 34 of the guiding body 35 designed as a thread tightener and is further piloted through in each case one eye 40 of the eyed rack 36. Between the guiding body 35 and the eyed rack 36 the threads 84*a* to 84*i* extend parallel to one another in a common plane. Corresponding to the representation of FIG. 4*a* embroidering is presently made with the thread 84*e* of the reel 32*e*. This thread 84*e* is guided in a straight line through the whirl chamber 65, i.e. it extends from the corresponding eye 40 in the eyed rack 36 straight through the whirl chamber 65 to a thread guide 85 arranged downstream of the latter, from where the thread 84*e* is guided to a thread tightener of the embroidering head 4 not shown. The cover 62 is closed, however the whirl chamber 65 is not actuated by compressed air through the compressed air nozzle 66. Subsequent to the thread 84*e* the thread 84*a* of the reel 32*a* is now to be used to continue embroidering. To this effect the rack drive 37 is acted upon in such a way that the eye 40 in the eyed rack 36, through which the thread 84*a* is guided, comes to take a position in alignment with the whirl chamber 65, as seen in FIG. 4*b*. The thread 84*e* is now drawn obliquely, since the eye 40 in the eyed rack 36 guiding it is not longer in alignment with the whirl chamber 65. Now the embroidering machine is stopped, i.e. the needle bar 5—only shown in FIGS. 1 and 2—is no longer drive to reciprocate.

Now the thread gripper and feeder 42 is operated by the lifting drive 56 being extracted first, so that the gripper 43 moves from an elevated position into a position right ahead of the eyed rack 36. To this effect the feeder drive 51 is moved out. The gripper stamp 47 is now lifted off the gripper abutment 44. The thread end 86 of the thread 84*a* protruding from the eyed rack 36 is in front of the gripper abutment 44. By actuation of the gripper drive 46 this thread end 86 is clamped between the gripper stamp 47 and the gripper abutment 44. Now the cover 62 is lifted off the whirl chamber 65 by actuation of the pivoting drive 68. Then the gripper 43 is pivoted upwards by actuation of the lifting drive 56. Then the piston rod 55 is entered into the cylinder 52, whereby the gripper 43 is moved over and across the thread joining device 60 while simultaneously drawing out the thread 84*a*. By corresponding actuation of the lifting drive 56 it is lowered between the thread guide 85 and the thread joining device 60, whereby the thread 84*a* drawn out is placed into the whirl chamber 65, in which the thread 84*e* so far used is still contained. It is shown in dotted lines as in FIG. 4*c*, which, however, shows it pivoted by 90°.

Figure 4D:
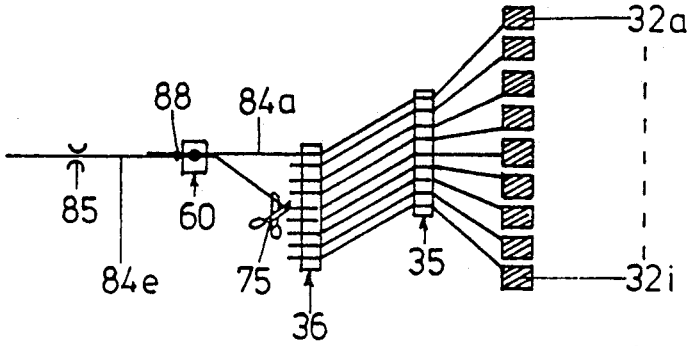
Figure 4E:
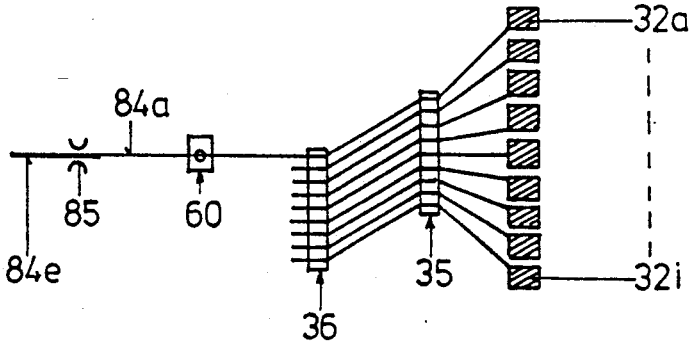

Then the cover 62 is again pivoted back into its position closing the channel-type whirl chamber 65 by actuation of the pivoting drive 68. Now compressed air is supplied to the compressed-air nozzle 66 via the compressed-air connection 67, the two threads 84*a* and 84*e* thus being whirled to join. To this effect and by actuation of the displacement drive 78 the thread cutter 75 is moved into a position under the thread 84*e* to be clipped. By corresponding actuation of the elevating drive 81 the support 77 of the thread cutter 75 is subsequently moved in front of the eye 40, through which the thread 84*e* is guided. By actuation of the cutter drive 76 the thread 84*e* is cut through. Attention is drawn to the fact that in this regard FIG. 3 shows a different thread than FIGS. 4*a* to 4*c*. The clipping of the thread 84*e* is shown in FIG. 4*d*.

As a result of the above-described actuation of the thread drawing device 21 only shown in FIGS. 1 and 2 the thread 84*e* is drawn out until the whirled section 88 of the threads 84*a* and 84*e* is threaded through the needle 7. Then this section 88 is clipped by means of the thread clipper 20 shown in FIGS. 1 and 2, a section 27 remaining. The machine is put into operation; embroidering is now continued with the new thread 84*a*.

The cover 62 is again opened by the pivoting drive 68 being correspondingly actuated. The feeder drive 51 and the lifting drive 56 are operated such that the gripper 43 again takes its catching position ahead of the eyed rack 36, the gripper stamp 47 also being again lifted off the gripper abutment 44.

Figure 5:
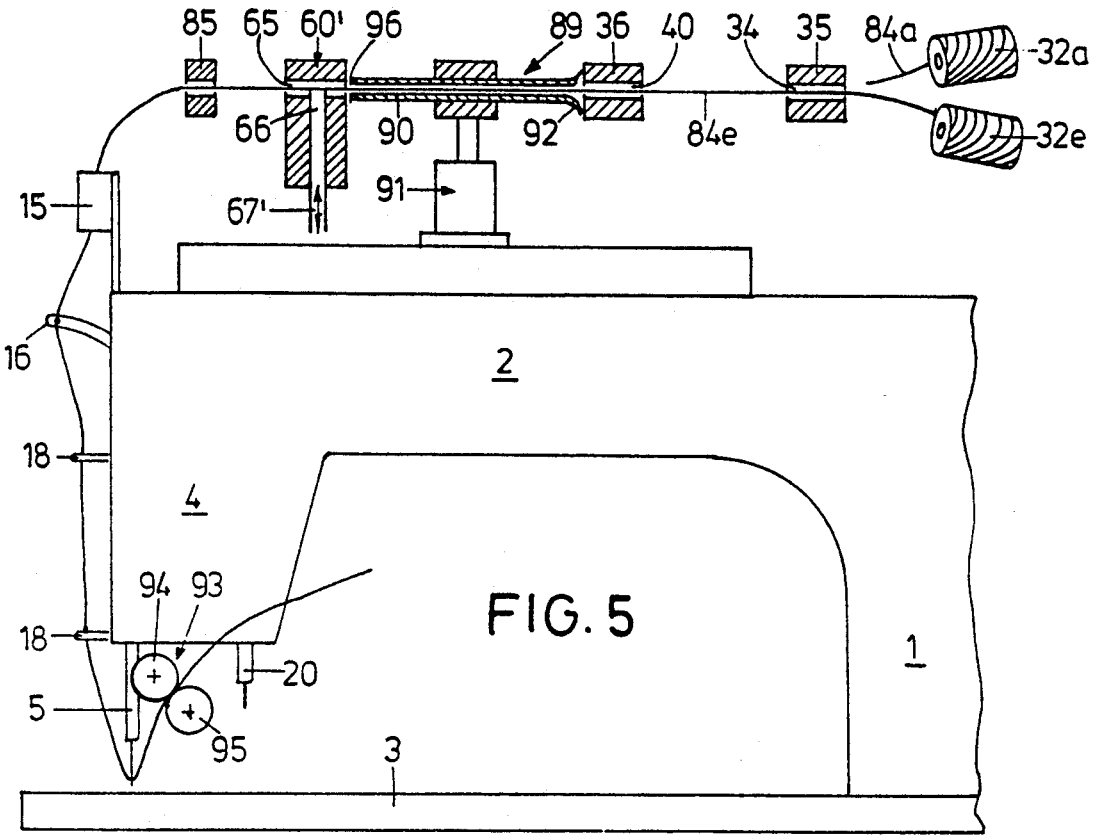
FIG. 5 is a strongly diagrammatic representation of a further embodiment of reel carrier, thread feeder and joining device.

FIGS. 5 and 6 illustrate an alternative of the embodiment according to FIG. 3 with a thread feeder 89 working with a suction pipe 90 being provided instead of the mechanical thread gripper and feeder there shown. The arrangement of the reels 32, the guidance of the threads 84 through the guiding eyes 34 of a guiding body 35, the structure and the drive of the eyed rack 36, the structure of the thread cutting device 74 and the thread guide 85 are identical with the embodiment according to FIG. 3, so that neither a detailed description nor a corresponding renewed illustration in the drawing is necessary.

As seen in FIG. 5, a suction pipe 90 is arranged between the eyed rack 36 and the thread joining device 60′ and can be moved by means of an elevating drive 91 into a position, in which, on the one hand, the suction pipe 90 is in alignment with an eye 40 of the eyed rack 36 and the channel-type whirl chamber 65 of the thread joining device 60. On the other hand, it can be moved downwards into a position, in which a suction funnel 92 of the suction pipe 90 facing the eyed rack 36 is free from the corresponding eye 40.

In this case the thread joining device 60 does not forcibly need a pivotable cover to produce a whirling connection between two threads. Furthermore, its compressed air nozzle 66 is not only connectable via a connection 67′ to a compressed air source, but also to an underpressure source, i.e. a vacuum.

Further, FIG. 5 shown a thread drawing device 93 consisting of two rolls 94, 95 one bearing against the other, of which one is drivable by means of a motor not shown. This thread drawing device 93 is followed by a thread clipper 20—as shown in FIGS. 1 and 2.

Figure 6A:
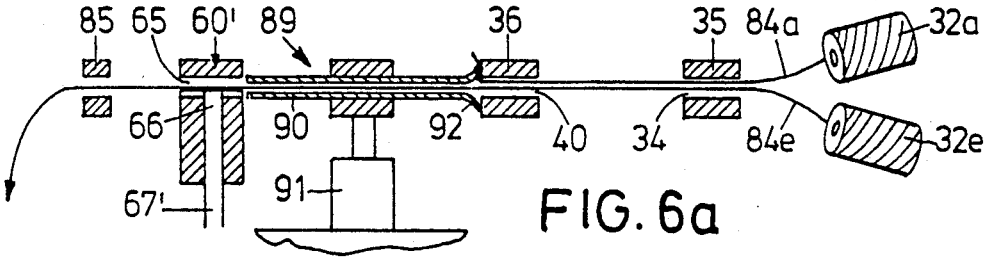
FIGS. 6*a* to 6*c* illustrates the operating sequence of the embodiment according to FIG. 5 when a new thread is fed.
Figure 6B:
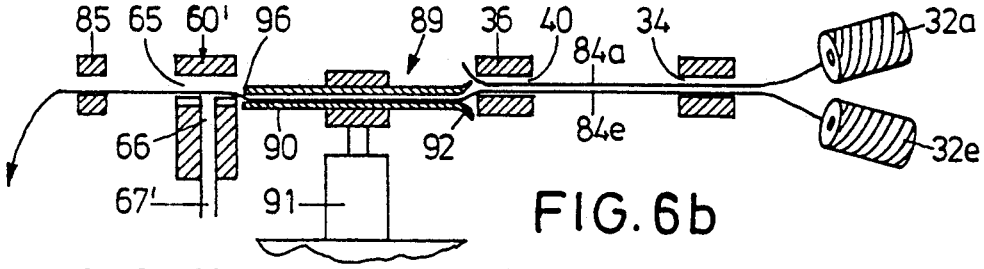

The function is as follows:

Corresponding to the representation in FIG. 6*a* the suction pipe 90 is in a position of alignment in front of the eye 40, on the one hand, and of the channel-type whirl chamber 65, on the other hand. The thread 84*e* presently embroidered with is therefore piloted from the reel 32*e* through the guiding eye 34 in the guiding body 35 to the guiding rack 36 and there through an eye 40. Throughout the stitching process it runs through the suction pipe 90 with its suction funnel 92 right ahead of the eye 40 and with its other discharge end 96 resting comparatively close to the thread joining device 60′.

Figure 6C:
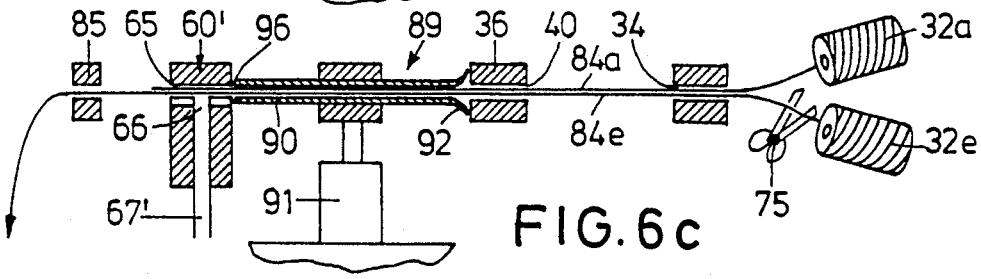

If a change of thread is to take place, i.e. if the thread 84*a* is to be used, then the eyed rack 36 is—as already described—displaced such that the eye 40 takes a place in front of the suction pipe 90, through which the thread 84*a* is guided. Corresponding to the representation in FIG. 6*b* the suction pipe 90 is now moved downwards by means of the elevating drive 91 to such an extent that the suction funnel 92 at least partially releases the corresponding eye 40 with the thread 84*e*. Then the elevating drive 91 is again driven in the reverse direction so that the suction pipe 90 again takes its position in alignment with the eye 40, on the one hand, and with the channel-type whirl chamber 65, on the other hand, as illustrated in FIG. 6*c*. Upon this elevating movement the thread end 86 of the thread 84*a* gets into the suction pipe 90. Now the embroidering machine is stopped. By this time the thread joining device 60′ had not been actuated neither by compressed air nor by vacuum. By way of the connection 67′ the channel-type whirl chamber 65 and thus also the suction pipe 90 are acted upon by vacuum, whereby the thread 84*a* is sucked through the suction pipe as far as into the whirl chamber 65. The position of the suction pipe 90 still being unchanged, compressed air is now introduced via the connection 67′ into the whirl chamber 65, whereby the threads 84*a* and 84*e* are whirled to join together. By means of the thread drawing device shown in FIG. 5 the thread 84*e* is subsequently drawn out until the thread 84*a* now to be used has been drawn through the needle. Then the clipping takes place as already described by means of the thread clipper 20.

What is claimed is:

1. A thread processing machine having a thread changing device, comprising:
   - a reel carrier (8, 31) for reels (9*a* to 9*e*, 32*a* to 32*i*);
   - a thread tightener (15) for a thread (23, 24; 84*a* to 84*i*) drawn off a reel (9*a* to 9*e*, 32*a* to 32*i*) in a direction of thread drawing;
   - a thread lever (16); and
   - a needle (7) reciprocatingly drivable, and
   - a thread joining device (11, 60, 60′) positioned downstream of said reel carrier (8, 31) in the direction of thread drawing, and having a compressed-air nozzle (13, 66) and a channel-type whirl chamber (12, 65), into which opens said compressed-air nozzle (13, 66).

2. A machine according to claim 1, wherein the thread joining device (11, 60, 60′) is associated with a thread cutting device (22, 74).

3. A machine according to claim 1, wherein a thread drawing device (21, 93) is arranged downstream of the needle (7) in the direction of thread drawing.

4. A machine according to claim 1, wherein a thread clipper (20) is positioned downstream of the needle (7) in the direction of thread drawing.

5. A machine according to claim 1, wherein between the reel carrier (31) and the thread joining device (60, 60′), a thread feeder (50, 89) is provided to feed a thread (84*a* to 84*i*) to the thread joining device (60, 60′).

6. A machine according to claim 5, wherein between the reel carrier (31) and the thread feeder (50, 89), an eyed rack (36) is positioned having eyes (40) each to guide one thread (84*a* to 84*i*) and is drivable by means of a rack drive (37) in a direction of displacement (41) at right angles to an operating direction of the thread feeder (50, 89) in such a way that one eye (40) at a time is movable into the operating path of the thread feeder (50, 89).

7. A machine according to claim 6, wherein the thread joining device (60, 60′) is associated with a thread cutting device (74) and wherein the thread cutting device (74) is positioned between the thread feeder (50, 89) and the eyed rack (36).

8. A machine according to claim 6, wherein the thread feeder (50) is in the form of a thread gripper and feeder (42), which is provided with a gripper (43) to seize a thread end (36) of a thread (84*a* to 84*i*) projecting from the eyed rack (36).

9. A machine according to claim 8, wherein the thread gripper and feeder (42) is provided with a lifting drive (56) to lift the gripper (43) over and across the thread joining device (60).

10. A machine according to claim 6, wherein the thread feeder (89) has a suction pipe (90), which is positioned between the eyed rack (36) and the thread joining device (60′) and wherein the whirl chamber (65) of the thread joining device (60′) is provided with a vacuum connection (67′).

* * * * *